US012571165B2

(12) United States Patent
Kiddoo et al.

(10) Patent No.: US 12,571,165 B2
(45) Date of Patent: Mar. 10, 2026

(54) SYSTEMS AND METHODS FOR PERFORMING MAINTENANCE OF AN AMUSEMENT PARK ATTRACTION SYSTEM

(71) Applicant: Universal City Studios LLC, Universal City, CA (US)

(72) Inventors: Michael Roy Kiddoo, Orlando, FL (US); Rebecca Barbara Dean, Orlando, FL (US)

(73) Assignee: UNIVERSAL CITY STUDIOS LLC, Universal City, CA (US)

( * ) Notice: Subject to any disclaimer, the term of this patent is extended or adjusted under 35 U.S.C. 154(b) by 900 days.

(21) Appl. No.: 17/853,073

(22) Filed: Jun. 29, 2022

(65) Prior Publication Data

US 2024/0003097 A1 Jan. 4, 2024

(51) Int. Cl.
*E01B 31/18* (2006.01)
*A63G 7/00* (2006.01)

(52) U.S. Cl.
CPC ..... *E01B 31/18* (2013.01); *A63G 7/00* (2013.01)

(58) Field of Classification Search
CPC ..... E01B 31/18; A63G 7/00
See application file for complete search history.

(56) References Cited

U.S. PATENT DOCUMENTS

| | | | | |
|---|---|---|---|---|
| 6,295,682 | B1 | 10/2001 | Klucznik | |
| 6,536,355 | B1 | 3/2003 | Amemiya | |
| 2007/0031217 | A1 | 2/2007 | Sharma | |
| 2010/0224098 | A1 * | 9/2010 | Gordon | A63G 7/00 104/53 |

FOREIGN PATENT DOCUMENTS

| | | | |
|---|---|---|---|
| CN | 108867210 | B | 6/2020 |
| CN | 211395253 | U | 9/2020 |
| GB | 2538450 | A | 11/2016 |

OTHER PUBLICATIONS

PCT/US2023/026003 International Search Report and Written Opinion mailed Oct. 18, 2023.
Malcolm Dobell, "Cleaning the Rail Head." Rail Engineer, Sep. 1, 2020, 11 pages, https://www.railengineer.co.uk/cleaning-the-rail-head/.

* cited by examiner

*Primary Examiner* — Robert J McCarry, Jr.
(74) *Attorney, Agent, or Firm* — Fletcher Yoder, PC

(57) ABSTRACT

A maintenance vehicle for an attraction system includes a maintenance component configured to output a material onto a path of a pathway system of the attraction system, a guide engager configured to capture a projection of the pathway system, the projection being separate from the path, and a set of wheels configured to move the maintenance vehicle along the pathway system while the guide engager maintains capture of the projection to move the maintenance component along the path.

20 Claims, 11 Drawing Sheets

SYSTEMS AND METHODS FOR PERFORMING MAINTENANCE OF AN AMUSEMENT PARK ATTRACTION SYSTEM

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Amusement parks and other entertainment venues have a variety of features to entertain guests. For example, an amusement park may include an attraction system, such as a ride (e.g., a roller coaster), a theatrical show, an extended reality system, and so forth. The attraction system may include a ride vehicle that may move throughout or within the attraction system, such as along a path or track, during operation to entertain guests. It may be desirable to perform a maintenance operation for the path to achieve a desired performance of the ride vehicle. It is now recognized that it may be difficult and/or inefficient to perform the maintenance operation for the path using existing techniques.

BRIEF DESCRIPTION

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, a maintenance vehicle for an attraction system includes a maintenance component configured to output a material onto a path of a pathway system of the attraction system, a guide engager configured to capture a projection of the pathway system, the projection being separate from the path, and a set of wheels configured to move the maintenance vehicle along the pathway system while the guide engager maintains capture of the projection to move the maintenance component along the path.

In an embodiment, a maintenance vehicle for an attraction system includes a maintenance component having a first maintenance section configured to output a material onto a surface of a path of a pathway system of the attraction system and a second maintenance section configured to treat the material outputted onto the surface, a path engager configured to contact the surface and capture the path, and a motivator configured to move the maintenance component along the path via the path engager while maintaining capture of the path to move the maintenance component along the path.

In an embodiment, a maintenance vehicle for an attraction system includes a maintenance component configured to output a material onto a path of a pathway system of the attraction system, a sensor configured to monitor a parameter associated with a property of a guide of the pathway system, and a control system. The control system is configured to receive data from the sensor, the data being indicative of the parameter associated with the property of the guide, and control movement of the maintenance vehicle based on the parameter to move the maintenance component along the path.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
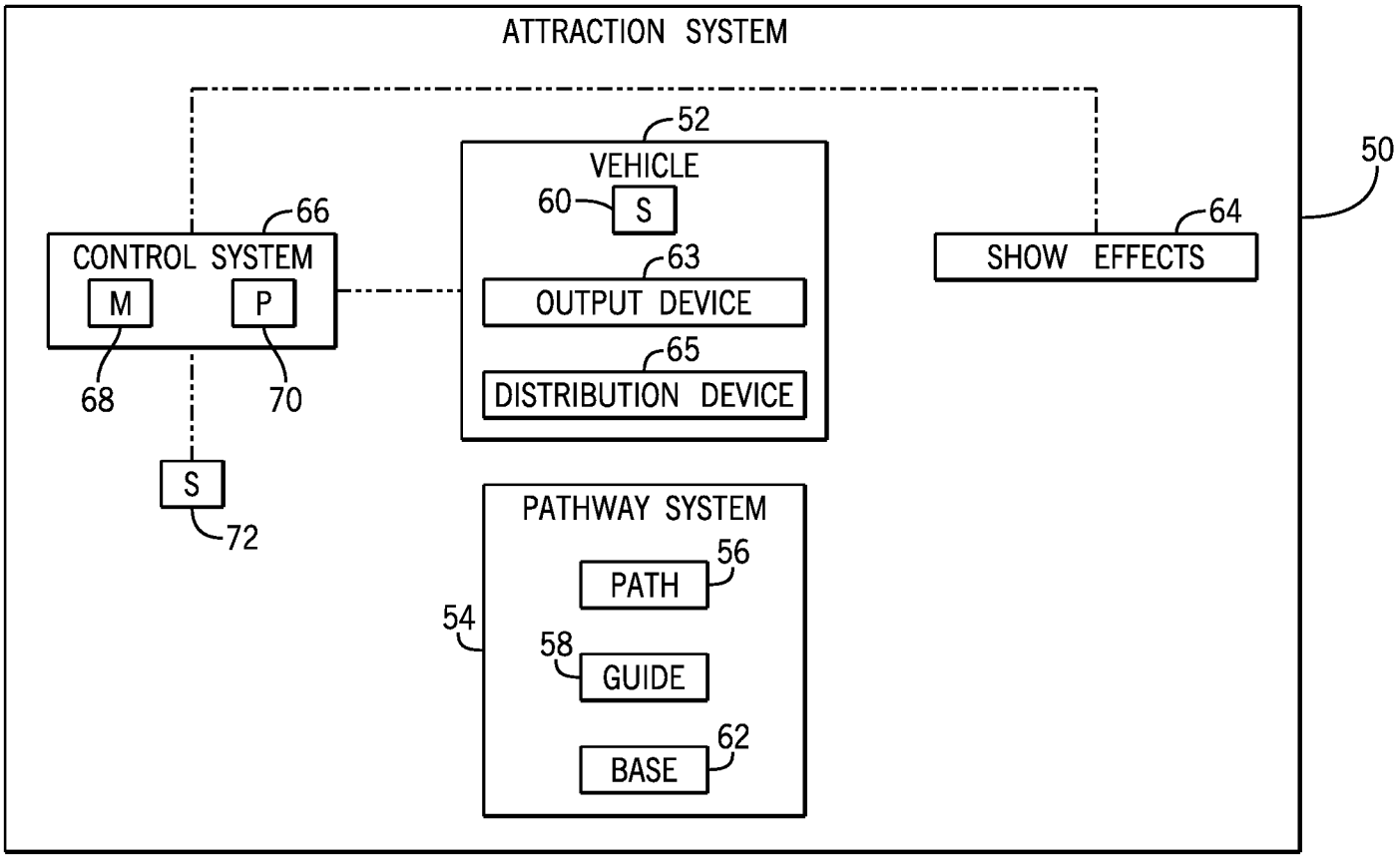
FIG. 1 is a schematic diagram of an embodiment of an attraction system that includes a pathway system and a maintenance vehicle, in accordance with an aspect of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure is directed to an attraction system of an amusement or theme park. The attraction system may include a roller coaster, a dark ride, a water ride, a theatrical show, a car ride, and so forth. For example, the attraction system may include a ride vehicle where guests may be positioned. During operation of the attraction system to entertain guests, the ride vehicle may move (e.g., translate) along a path (e.g., a track, a rail, a pathway) to impart a movement sensation (e.g., a gravitational force, an inertial force, a postural adjustment) on the guests to provide entertainment. Additionally, or alternatively, the attraction system may include a variety of show effects, and the ride vehicle may carry the guests to different locations of the attraction system to experience different show effects. It may be desirable to maintain a property or characteristic of the path along which the ride vehicle travels to achieve a desirable performance of the ride vehicle to entertain the guests. For example, maintaining a structural integrity, a surface finish, a geometry, a texture, a topography, a profile, and the like of the path may enable a desirable speed, a desirable smoothness, a desirable acceleration, a desirable rotation, or any other motion associated with the ride vehicle to be achieved. Additionally, maintaining the path may increase a useful lifespan of the attraction system, such as of the ride vehicle and/or of the path.

Unfortunately, existing approaches and techniques for maintaining a path may be difficult and/or inefficient. For example, an entertainment operation of the attraction system may be suspended in order to enable maintenance to be performed. Thus, the attraction system may not entertain guests while maintenance is being performed. Moreover, performance (e.g., manual performance) of an existing maintenance operation may be time consuming. For instance, multiple users, such as technicians and operators, may be utilized to complete (e.g., manually complete) a single maintenance operation, such as to replace one or more sections of the path. Additionally, or alternatively, an existing maintenance operation may not adequately maintain the path for a sustained period of time. As a result, maintenance operations, as well as corresponding suspended entertainment operations of the attraction system, may be frequently performed. In this manner, existing maintenance operations may substantially reduce efficient operation of the attraction system to entertain guests.

Thus, it is presently recognized that improving maintenance of the path may increase efficient operation of the attraction system to entertain guests. Accordingly, embodiments of the present disclosure are directed to a maintenance vehicle designed to operate and perform maintenance for a path of the attraction system. The maintenance vehicle may include different maintenance components to perform a maintenance operation. For example, the maintenance components may be operable to prepare the path by removing particles (e.g., dust, debris) from the path and/or outputting a first material or substance that may improve application (e.g., binding) of a second material or substance onto the path. The maintenance components may also be operable to apply the second material, which may be operable to bind to the path, and/or distribute the second material along the path. The second material may adjust a property or condition, such as a profile, a quality, and/or a texture, of the path. The maintenance components may further be operable to remove excess deposits of the applied second material and/or treat or cure the applied second material to achieve desirable application of the second material. Thus, the maintenance components may cooperatively operate to implement the second material onto the path in a desirable manner that maintains the path and achieves desirable operation of the attraction system to entertain guests.

Furthermore, the maintenance vehicle may be operable to move by utilizing an existing feature of the attraction system. By way of example, the attraction system may include a guide (e.g., a rail, a lip, a groove) that a ride vehicle of the attraction system may use to facilitate movement along a path (e.g., a track) during the entertainment operation of the attraction system. The maintenance vehicle may also be operable to use the guide to move along the path during operation to maintain the path. For instance, the maintenance vehicle may be operable to capture the guide. Thus, the guide may physically cause the maintenance vehicle to navigate (e.g., steer) the path. Additionally, or alternatively, the maintenance vehicle may include a sensor operable to determine a property (e.g., a positioning, a visual indicator) of the guide with respect to the maintenance vehicle, and the movement of the maintenance vehicle may be controlled based on the monitored property. In this manner, the maintenance vehicle may utilize the guide to move along the path during a maintenance operation in a similar route as that of the ride vehicle during the entertainment operation of the attraction system in order to perform maintenance for the path. Furthermore, utilization of the guide may enable the maintenance vehicle to perform maintenance without implementation of an additional system or component (e.g., a steering system and corresponding controller to operate the steering system) dedicated to driving desirable movement of the maintenance vehicle along the path. As such, a cost associated with installation and/or operation of the maintenance vehicle may be reduced or limited.

With the preceding in mind, FIG. 1 is a schematic diagram of an embodiment of an attraction system 50. The attraction system 50 may be operable to entertain one or more guests of the attraction system 50. In an embodiment, the attraction system 50 may include a vehicle 52 where the guests may be positioned during an entertainment operation of the attraction system 50. The vehicle 52 may travel throughout or within the attraction system 50, such as along a pathway system 54, during the entertainment operation. By way of example, movement of the vehicle 52 throughout the attraction system 50 may impart movement sensations on the guests to entertain the guests. The pathway system 54 may include a path 56 (e.g., an open pathway, a rail, a floor) along which the vehicle 52 travels during the entertainment operation of the attraction system 50. For instance, the vehicle 52 may be in contact or in engagement with the path 56 during the entertainment operation of the attraction system 50. In one embodiment, the pathway system 54 may include a guide 58 that operates to direct or steer the vehicle 52 along the path 56. As an example, the guide 58 may include a projection, an extension, or a protrusion to which the vehicle 52 may be coupled. Thus, the guide 58 may physically direct the vehicle 52 along the path 56. As another example, the guide 58 may direct the vehicle 52 without contacting the vehicle 52. For instance, the vehicle 52 may include a vehicle sensor 60, which may represent one or more sensors, operable to monitor a parameter associated with the guide 58, and the vehicle 52 may be moved based on the parameter of the guide 58. By way of example, the vehicle sensor 60 may be operable to receive a signal or other indicator (e.g., a visual indicator) deflected off or output by the guide 58 (e.g., a transmitter, barcode), and the vehicle 52 may be moved (e.g., steered, directed) based on the signal received by the vehicle sensor 60.

The pathway system 54 may also include a base 62, which may include portions of the pathway system 54 that the vehicle 52 may not engage with or contact during the entertainment operation of the attraction system 50. As an example, the base 62 may include a surrounding area (e.g., flooring) around the path 56. For instance, a user, such as a guest, an operator, and/or a technician, may utilize the base 62 to navigate through the attraction system 50, such as toward or away from the vehicle 52.

The attraction system 50 may also include show effects 64 to provide further entertainment to the guests. The show effects 64 may include, for example, an animated figure, a lighting effect, a sound effect, a smoke effect, and so forth. During the entertainment operation of the attraction system 50, the show effects 64 may be operated to provide effects that may be experienced (e.g., seen, heard) by the guests, such as the guests in the vehicle 52. As such, the show effects 64 and the movement of the vehicle 52 may cooperatively entertain the guests during the entertainment operation of the attraction system 50.

It may be desirable to maintain the pathway system 54 to achieve a desirable operation of the vehicle 52, such as to provide entertainment to the guests. For example, it may be desirable to maintain a surface finish, a geometry, a quality, a texture, a topography, a profile, and/or any other suitable property or characteristic of the path 56 to enable the vehicle 52 to travel in a desired manner throughout or within the attraction system 50 during the entertainment operation. For this reason, a maintenance operation may be performed with respect to the pathway system 54 to maintain the path 56. During the maintenance operation, the entertainment operation of the attraction system 50 may be suspended. Thus, guests may not be positioned within the vehicle 52. Instead, the vehicle 52 may be used to maintain the property of the path 56. By way of example, the vehicle 52 may include various path maintenance components, such as an output device 63 that operates to deposit a material or substance onto the path 56 and/or a distribution device 65 (e.g., a spreader) that operates to distribute the output material across the path 56. The vehicle 52 may be travel along the path 56, as facilitated by the guide 58, the path 56, and/or the base 62, to apply the material to and maintain different portions of the path 56. Application of the material may maintain the property of the path 56, thereby enabling desirable movement of the vehicle 52 during the entertainment operation of the attraction system 50. Although the illustrated attraction system 50 includes a single vehicle 52 that may carry guests in the entertainment operation of the attraction system 50 and maintain the path 56 in the maintenance operation of the attraction system 50, separate vehicles may be used to carry the guests and to maintain the path 56 for different operations of the attraction system 50.

A control system 66 (e.g., an automation controller, a programmable controller, an electronic controller) of the attraction system 50 may be communicatively coupled to the vehicle 52 and/or the show effects 64. The control system 66 may include a memory 68 and processing circuitry 70. The memory 68 may include volatile memory, such as random access memory (RAM), and/or non-volatile memory, such as read-only memory (ROM), optical drives, hard disc drives, solid-state drives, or any other non-transitory computer-readable medium that includes instructions. The processing circuitry 70 may be operable to execute such instructions. For example, the processing circuitry 70 may include one or more application specific integrated circuits (ASICs), one or more field programmable gate arrays (FPGAs), one or more general purpose processors, or any combination thereof.

During the entertainment operation of the attraction system 50, the control system 66 may function to operate the vehicle 52 to drive movement of the vehicle 52 along the path 56, thereby entertaining guests positioned in the vehicle 52. The control system 66 may also function to operate the show effects 64 during the entertainment mode to enable the show effects 64 to entertain the guests. Moreover, the control system 66 may function to operate the vehicle 52 or another vehicle to perform the maintenance operation to maintain the pathway system 54. For example, the control system 66 may function to cause the vehicle 52 to move along the path 56 (e.g., based on data received from the vehicle sensor 60 or a sensor external to the vehicle 52) and to apply material to the path 56 to maintain the property of the path 56.

In an embodiment, the control system 66 may be communicatively coupled to or include a sensor 72 (e.g., a sensor separate from the vehicle sensor 60), which may represent multiple sensors. The sensor 72 (e.g., a camera, motion sensor) may monitor a parameter and output data indicative of the parameter to the control system 66. The control system 66 may operate the vehicle 52 to perform the maintenance operation based on the data (e.g., a path characteristic, a vehicle location, a vehicle positioning over time) received from the sensor 72. In an example, the parameter may include the property of the path 56, such as an identified irregularity, aberration, abnormality, and/or anomaly (e.g., a structural change, a collection of undesirable material) associated with the path 56. To this end, the sensor 72 may include an optical sensor, a strain gauge, a distance sensor, or any other suitable type of sensor that operates to identify the deformation and/or structural change. In another example, the parameter may include a time of operation (e.g., a ride cycle of the entertainment operation) of the attraction system 50. For instance, the control system 66 may function to operate the vehicle 52 to perform the maintenance operation at a particular frequency (e.g., after a threshold quantity of ride cycles). In a further example, the control system 66 may function to operate the vehicle 52 in response to a user input (e.g., regardless of the data received from the sensor 72), which may include a request to perform the maintenance operation. Indeed, the control system 66 may be configured to operate the vehicle 52 in any suitable manner to maintain the pathway system 54 and enable the attraction system 50 to operate (e.g., in the entertainment operation) desirably.

Figure 2:
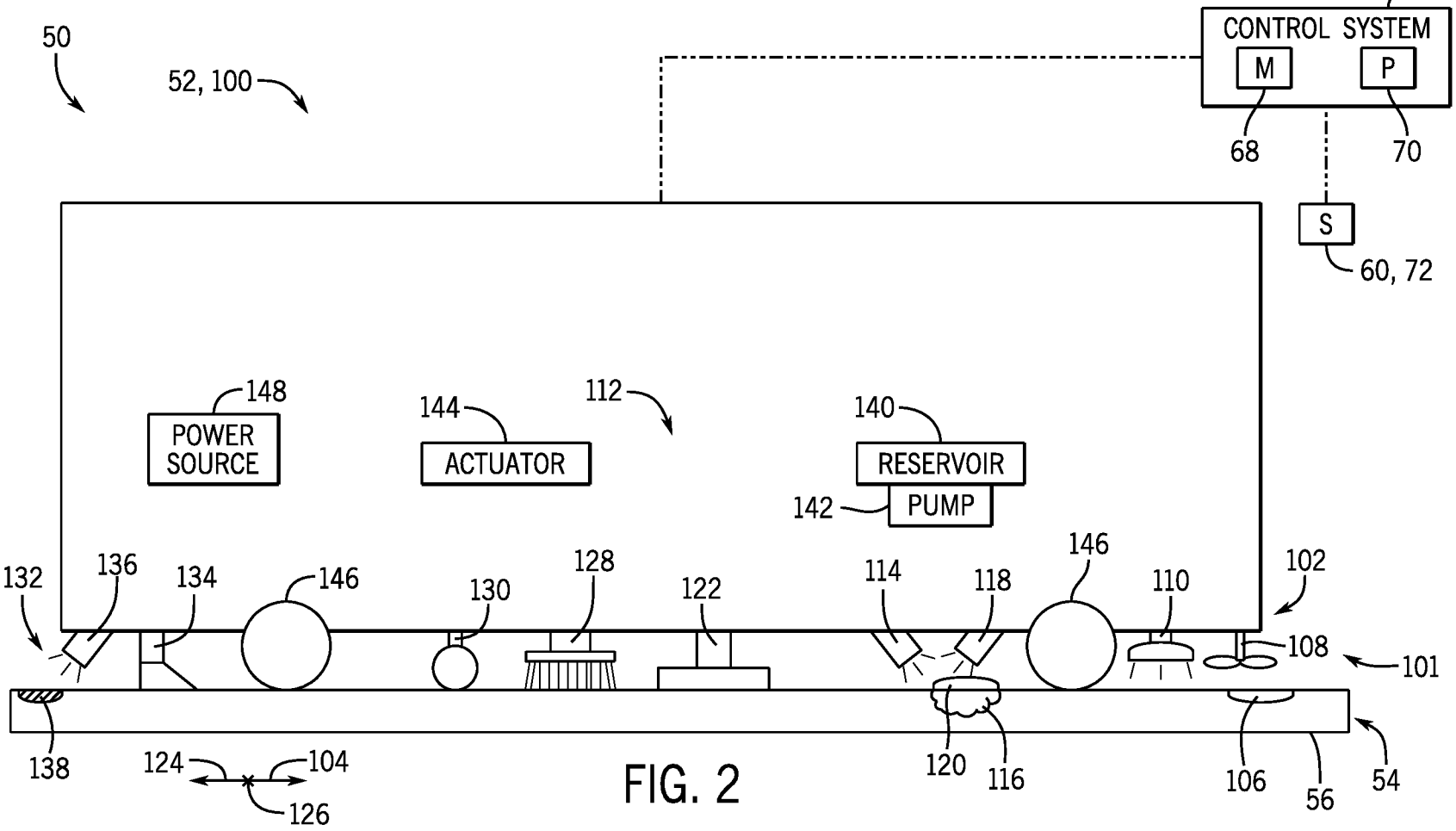
FIG. 2 is a schematic side view of an embodiment of a maintenance vehicle for performing a path maintenance operation for an attraction system, in accordance with an aspect of the present disclosure.

FIG. 2 is a schematic side view of an embodiment of a maintenance vehicle 100 (e.g., one of the vehicles 52 of FIG. 1) configured to maintain the pathway system 54. The maintenance vehicle 100 may include multiple different maintenance components 101 configured to operate during a maintenance operation in order to mitigate an irregularity (e.g., a flaw, a deformation, an accumulation of undesirable material, a formation) associated with the pathway system 54. By way of example, operations of the maintenance components 101 may include applying, distributing, and/or binding material onto the path 56 of the pathway system 54 to maintain the path 56.

In one embodiment, the maintenance vehicle 100 may include a first, lead, front, or initial section or maintainer 102 (e.g., a preparation section) configured to prepare (e.g., sweep, mop, spray off, blow off, polish, grind) a target portion, section, segment, or spot of the path 56 of the pathway system 54 prior to applying certain material onto the path 56. That is, the maintenance components 101 of the first section 102 of the maintenance vehicle 100 may initially treat a part of the path 56 prior to operation of other maintenance components 101 with respect to the part of the path 56. By way of example, the maintenance vehicle 100 may be configured to move (e.g., translate) along the path 56 in a first direction 104 toward a first irregularity 106 (e.g., a dent, a chip, spur). The maintenance vehicle 100 may initially prepare the portion of the path 56 adjacent to the first irregularity 106 via the first section 102. Preparation of the path 56 via the first section 102 may enable subsequent material to be applied more effectively to maintain the path 56, such as to mitigate the first irregularity 106.

For example, the first section 102 may include a fan 108 configured to force or draw air across the path 56 to remove certain undesired particles, such as dust, debris, fluid, and so forth, from the path 56. In another example, the fan 108 may represent a grinder or polisher that operates to remove spurs or lifted portions of the path 56. Removing such particles and spurs may expose a surface of the path 56, such as to increase access to the first irregularity 106. The first section 102 may additionally, or alternatively, include a first output device 110 (e.g., a first nozzle, a first sprayer, a first outlet) configured to output (e.g., spray) a first material or substance onto the path 56, such as onto the first irregularity 106. As an example, the first material may include a liquid, such as water and/or alcohol (e.g., ethanol), configured to remove additional particles from the path 56 and further increase access to the first irregularity 106. As another example, the first material may be of a particular temperature, such as above a threshold temperature and/or below a threshold temperature, to adjust a temperature of the path 56. For instance, the first material may condition the path 56 to reach a target temperature (e.g., a sufficiently high temperature, a sufficiently low temperature) that enables another material or substance to be applied to the path 56 more easily and/or effectively. As a further example, the first material may have a chemical composition that facilitates application of another material to the path 56.

The maintenance vehicle 100 may also include a second, intermediate, or middle section or maintainer 112 (e.g., an application section) having maintenance components 101 configured to apply a second material or substance, which may be configured to bind, adhere, attach, or otherwise affix to a portion of the path 56 after the first section 102 has prepared the portion. By way of example, the material may include a resin (e.g., epoxy), an adhesive (e.g., superglue), paint, a plastic, a filler (e.g., a metal filling within a resin), concrete, a sealer, a coating (e.g. a hardness coating, an ultraviolet coating), another suitable material, or any combination thereof. To this end, the second section 112 may include a second output device 114 (e.g., a second nozzle, a second sprayer, a second outlet) configured to output the second material onto the path 56. For instance, the second output device 114 may operate to selectively output the second material onto a second irregularity 116 (e.g., an irregularity on which the first section 106 has previously operated). In an embodiment, the second section 112 may also include a third output device 118, which may also be configured to output the second material, thereby enabling increased application of the second material onto the path 56. Additionally, or alternatively, the second output device 114 and the third output device 118 may be configured to apply co-reactant materials configured to mix and react upon mixing. By way of example, the second output device 114 may be configured to output a resin, the third output device 118 may be configured to output a hardener, and the resin and the hardener may mix and cure the resin, such as to form a resultant product (e.g., a hardened polymer).

Operation of the second output device 114 and/or the third output device 118 may cause an excessive amount of the second material to be output onto the path 56. For example, operation of the second output device 114 and/or the third output device 118 may result in a deposit or residue 120 of the second material on the path 56 (e.g., on the second irregularity 116). For this reason, the second section 112 of the maintenance vehicle 100 may include maintenance components 101 configured to mitigate or reduce the deposit 120 of the second material, such as by distributing, leveling, spreading, and/or mixing the second material across the path 56. Distribution of the second material may enable the second material to mitigate the second irregularity 116 more effectively or desirably, such as by filling, occluding, and/or overlapping with a greater portion of the second irregularity 116. By way of example, the second section 112 may include a wiper 122 (e.g., a blade, a squeegee, a scraper), which may move (e.g., translate) along the path 56, such as in the first direction 104, in a second direction 124 opposite the first direction 104, in a third direction 126 crosswise to (e.g., perpendicular to) the first and second directions 104, 124, or in any other suitable direction along the path 56. The second section 112 may additionally, or alternatively, include a brush 128 configured to sweep the path 56, a roller 130 configured to compress the deposit 120, and/or any other suitable component (e.g., a press, a fan) configured to distribute the deposit 120.

The maintenance vehicle 100 may further include a third, trailing, or end section or maintainer 132 (e.g., a finish section) having maintenance components 101 configured to finish the portion of the path 56 on which the second material may be applied. As an example, the third section 132 may include a remover 134 (e.g., a scraper, a vacuum) configured to remove remaining excess amounts or deposits of the second material. As another example, the third section 132 may include a treatment device 136 configured to treat the applied second material, such as by curing (e.g., via output of heat, air, water, ultraviolet radiation, a chemical, an electrical current) the second material, such as to solidify the second material from a fluid state to a solid state, and/or providing a surface finish (e.g., via a sander, a grinder, a filer, a sandblaster) of the path 56. Operation of the third section 132 may provide a desirable property of the path 56 after the second material has been applied to the path 56 in order to enable desirable movement of the vehicle 52 (e.g., a vehicle 52 in which guests are positioned) along the path 56 during the entertainment operation of the attraction system 50. For example, completed operation of the third section 132 may result in a mitigated irregularity 138, which may, for example, have a quality, a texture, a profile, a geometry, and/or a smoothness that is desirable, such as to match that of a remainder of the path 56. In this manner, the maintenance operation performed by the maintenance vehicle 100 may enable the path 56 to have a more desirable (e.g., uniform) quality throughout different portions of the path 56.

The maintenance vehicle 100 may include a reservoir 140 (e.g., representative of one or more reservoirs) configured to store various materials or substances used by the maintenance vehicle 100 during performance of the maintenance operation. For example, the reservoir 140 may be configured to store the first material output by the first output device 110, the second material output by the second output device 114 and/or the third output device 118, a material output by the treatment device 136, or any combination thereof. In one embodiment, the reservoir 140 may be configured to receive material that has previously been output. For example, the remover 134 may be configured to direct the excess amounts of the second material from the path 56 to the reservoir 140, thereby recycling the second material and enabling additional application of the recycled second material. The maintenance vehicle 100 may further include a pump 142 configured to direct the material (e.g., the first material, the second material) from the reservoir 140 to a maintenance component 101 of the maintenance vehicle 100, such as to the first output device 110, the second output device 114, the third output device 118, and/or the treatment device 136.

The maintenance vehicle 100 may further include an actuator 144 (e.g., representative of one or more actuators) configured to cause the maintenance vehicle 100 to perform the maintenance operation. For example, the actuator 144 (e.g., a motors linear actuator) may be configured to cause the fan 108 to operate (e.g., rotate), move the wiper 122, the brush 128, and/or the roller 130, operate the pump 142, adjust orientation of the first output device 110, the second output device 114, the third output device 118, and/or the treatment device 136, operate the remover 134, or any combination thereof. The actuator 144 may additionally, or alternatively, be configured to drive movement of the maintenance vehicle 100. By way of example, the maintenance vehicle 100 may include one or more wheels 146 configured to engage with the pathway system 54 and rotate relative to the pathway system 54 to drive movement of the maintenance vehicle 100 along the path 56. The actuator 144 may be a motivator configured to cause the wheels 146 to rotate in order to move the maintenance vehicle 100 along the path 56. In a further embodiment, the maintenance vehicle 100 may be configured to utilize another feature to move along the path 56. For example, the maintenance vehicle 100 may include a feature configured to couple to or engage with a component (e.g., a chain, a cable) of the pathway system 54 that moves to drive corresponding movement of the maintenance vehicle 100, a conveyor or belt configured to rotate to drive movement of the maintenance vehicle 100 along the path 56, and/or any other suitable feature configured to engage with the pathway system 54 to enable movement of the maintenance vehicle 100 along the path 56.

In one embodiment, the maintenance vehicle 100 may be configured to operate via an internal power source 148, such as stored power provided from a battery, harvested power (e.g., solar energy, electrical power generated via kinetic energy, wind energy), and/or any other power source that is integral to or a part of (e.g., enclosed within) the maintenance vehicle 100 (e.g., a chassis of the maintenance vehicle 100). The internal power source 148 may enable operation of various components of the maintenance vehicle 100, such as of the actuator 144. Indeed, using the power provided by the internal power source 148, the maintenance vehicle 100 may be able to perform the maintenance operation without receiving power from an external power source or a power source that is separate from (e.g., not coupled to) the maintenance vehicle 100. In an additional or alternative embodiment, the maintenance vehicle 100 may be configured to receive power from an external power source, such as grid power, a generator, an external battery, and so forth, in order to perform the maintenance operation.

The control system 66 may be configured to operate the maintenance vehicle 100. By way of example, the control system 66 may be configured to operate the actuator 144 in order to drive movement of the maintenance vehicle 100 along the path 56 and/or to operate various components to mitigate irregularities of the path 56. Indeed, the control system 66 may operate the actuator 144 to control a speed in which the maintenance vehicle 100 moves along the path 56 (e.g., to enable effective performance of each of the sections 102, 112, 132 of the maintenance vehicle 100), a direction of movement of the maintenance vehicle 100 (e.g., in the first direction 104, in the second direction 124, in a direction crosswise to the directions 104, 124), and so forth to move the maintenance vehicle 100 via the wheels 146. In an embodiment, the control system 66 may operate to determine the location of the irregularities of the path 56 (e.g., via data received from the sensor 72) and may selectively operate the maintenance vehicle 100 to mitigate the irregularities. That is, the control system 66 may cause the maintenance vehicle 100 to mitigate portions of the path 56 having identified irregularities (e.g., irregularities of a particular type or magnitude) and not other portions of the path 56. For example, the control system 66 may cause the maintenance vehicle 100 to move to a target location based on a location of an irregularity. The control system 66 may be configured to suspend operation of the maintenance components 101 (e.g., of the output devices 110, 114, 118) until a determination is made that the maintenance vehicle 100 is at the target location. In response to determining that the maintenance vehicle 100 is at the target location, the control system 66 may be configured to operate the maintenance components 101 to mitigate the identified irregularity. As such, energy consumption associated with operation of the maintenance components 101 may be reduced or limited and specifically used for addressing the identified irregularities.

Figure 3:
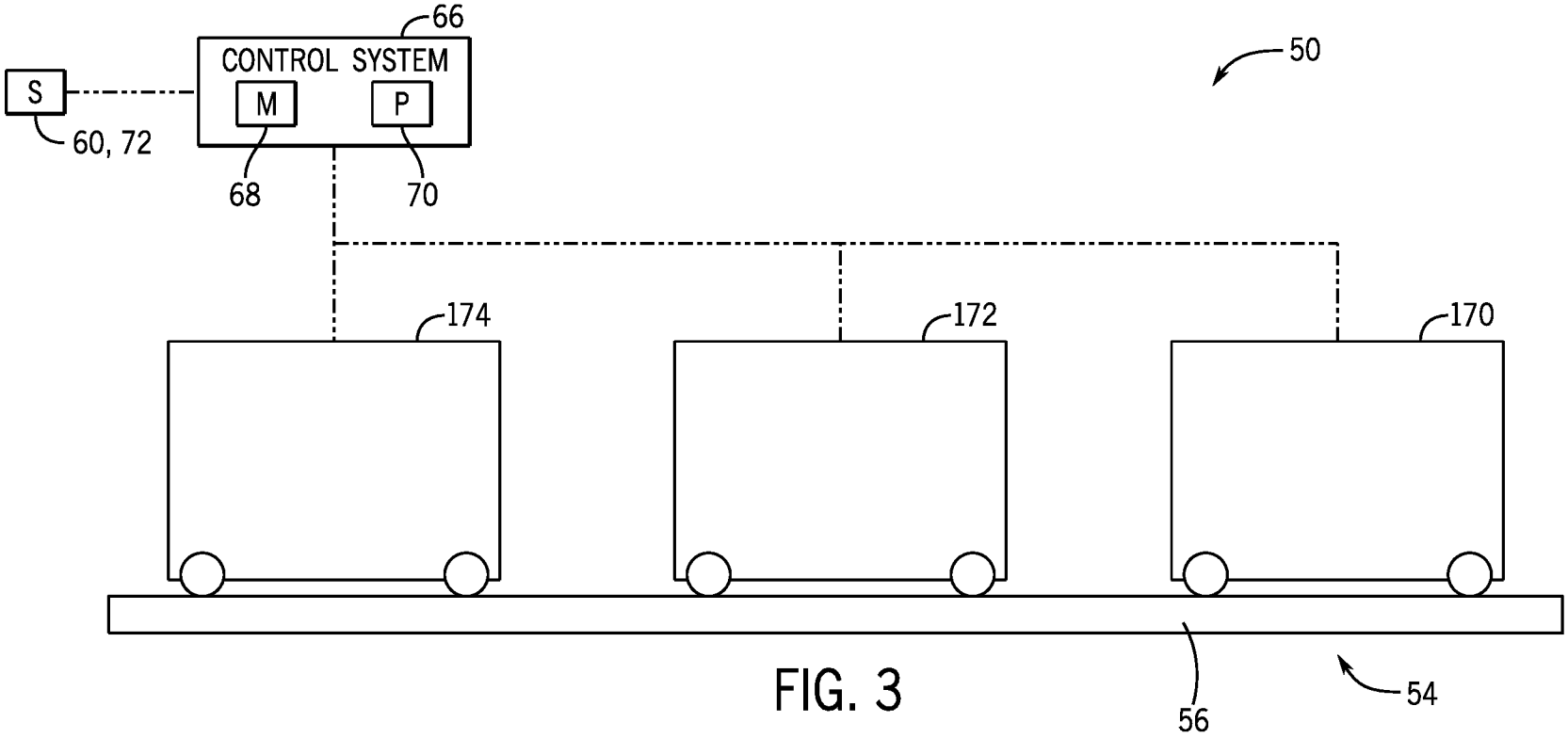
FIG. 3 is a schematic side view of an embodiment of multiple maintenance vehicles for performing a path maintenance operation for an attraction system, in accordance with an aspect of the present disclosure.

FIG. 3 is a schematic side view of an embodiment of multiple maintenance vehicles configured to perform a maintenance operation for the pathway system 54. By employing multiple different maintenance vehicles for specific tasks, different configurations of vehicles can be assembled for a particular task. Each maintenance vehicle may include different maintenance components configured to operate such that the maintenance vehicles may cooperatively maintain the path 56 and different configurations can be used depending on the maintenance need. For example, a first, lead, front, or initial maintenance vehicle 170 (e.g., a lead maintainer, a preparation vehicle, a front vehicle) may be configured to prepare the path 56, such as in a similar manner as that of the first section 102 of the maintenance vehicle 100 of FIG. 2. For this reason, the first maintenance vehicle 170 may include maintenance components, such as a fan configured to direct air across the path 56, an output device configured to output a material or substance onto the path 56, and/or any other suitable component configured to prepare the path 56 to enable additional material to be applied to the path 56. As an example of benefits of modularity, different lead vehicles or other vehicles may be used depending on the nature of a repair.

A second, intermediate, or middle maintenance vehicle 172 (e.g., an intermediate maintainer, an application vehicle) may be configured to apply material configured to bind to the path 56. For instance, the second maintenance vehicle 172 may include an output device configured to output the material. The second maintenance vehicle 172 may additionally, or alternatively, may include various maintenance components, such as a wiper, a brush, and/or a roller, configured to distribute the output material across the path 56. As such, operation of the second maintenance vehicle 172 may be similar to that of the second section 112 of the maintenance vehicle 100 of FIG. 2.

A third, trailing, or end maintenance vehicle 174 (e.g., a trailing maintainer, a finish vehicle) may be configured to finish the path 56, such as by removing excess amounts of the output material and/or treating the output material. As an example, the third maintenance vehicle 174 may include a remover and/or a treatment device. In this manner, operation of the third maintenance vehicle 174 may be similar to that of the third section 132 of the maintenance vehicle 100 of FIG. 2.

The control system 66 may be communicatively coupled to each of the maintenance vehicles 170, 172, 174 and may be configured to control operation of the maintenance vehicles 170, 172, 174. For instance, the control system 66 may be configured to enable and/or suspend operation of the maintenance vehicles 170, 172, 174 and/or cause the maintenance vehicles 170, 172, 174 to move relative to one another. Indeed, the control system 66 may operate the maintenance vehicles 170, 172, 174 independently of one another. As an example, in response to identifying an irregularity of the path 56, the control system 66 may cause the first maintenance vehicle 170 to move toward the irregularity (e.g., without moving and/or operating the second maintenance vehicle 172 and/or the third maintenance vehicle 174). In response to a determination that the first maintenance vehicle 170 is within a target location associated with the irregularity (e.g., within a target distance of the irregularity), the control system 66 may operate the first maintenance vehicle 170 to mitigate the irregularity, such as by operating maintenance components of the first maintenance vehicle 170 while moving the first maintenance vehicle 170 at a first speed along the path 56.

In response to a determination that the first maintenance vehicle 170 has completed its operation to mitigate the irregularity (e.g., after a threshold period of time since the first maintenance vehicle 170 has moved past the irregularity), the control system 66 may cause the second maintenance vehicle 172 to move toward the irregularity (e.g., without moving and/or operating the first maintenance vehicle 170 and/or the third maintenance vehicle 174). In response to a determination that the second maintenance vehicle 172 is within a target location associated with the irregularity, the control system 66 may operate the maintenance components of the second maintenance vehicle 172 while moving the second maintenance vehicle 172 at a second speed, which may be different from the first speed associated with the first maintenance vehicle 170, along the path 56. Similarly, in response to a determination that each of the first maintenance vehicle 170 and the second maintenance vehicle 172 have completed their operations to mitigate the irregularity (e.g., after a threshold period of time since the second maintenance vehicle 172 has moved past the irregularity), the control system 66 may cause the third maintenance vehicle to move toward the irregularity (e.g., without moving and/or operating the first maintenance vehicle 170 and/or the second maintenance vehicle 172). In response to a determination that the third maintenance vehicle 174 is within a target location associated with the irregularity, the control system 66 may operate the maintenance components of the third maintenance vehicle 174 while moving the third maintenance vehicle 174 at a third speed, which may be different from the first speed associated with the first maintenance vehicle 170 and/or the second speed associated with the second maintenance vehicle 172, along the path 56. In this manner, the control system 66 may sequentially operate the maintenance vehicles 170, 172, 174 to perform the maintenance operation for mitigating the irregularity and maintaining the path 56. A benefit of the modularity or use of separate vehicles for maintenance components includes the ability to spend different amounts of time on maintenance aspects by the different vehicles.

Additionally, or alternatively, the control system 66 may be configured to operate the maintenance vehicles 170, 172, 174 to address respective irregularities. By way of example, the control system 66 may be configured to operate the first maintenance vehicle 170 to prepare a first portion of the path 56 associated with a first irregularity, the control system 66 may be configured to operate the second maintenance vehicle 172 to apply and/or distribute material with respect to a second portion of the path 56 associated with a second irregularity, and the control system 66 may be configured to operate the third maintenance vehicle 174 to finish material applied to a third portion of the path 56 associated with a third irregularity. Indeed, the control system 66 may be configured to selectively control performance of different maintenance operations for the path 56 (e.g., for different portions of the path 56) via separate operation of the maintenance vehicles 170, 172, 174.

Although the illustrated embodiment includes three maintenance vehicles 170, 172, 174 configured to perform respective operations, there may be any suitable number of maintenance vehicles, such as two maintenance vehicles or more than three maintenance vehicles, configured to operate and cooperatively maintain the pathway system 54. The control system 66 may be communicatively coupled to each of the maintenance vehicles to control operation of the maintenance vehicles, such as to control operation of respective maintenance components of the maintenance vehicles and/or to move the maintenance vehicles relative to one another. More efficient operations or suitable may be achieved by, for example, including more vehicle types for operations having a longer duration and fewer vehicle types for operations having a shorter duration.

Figure 4:
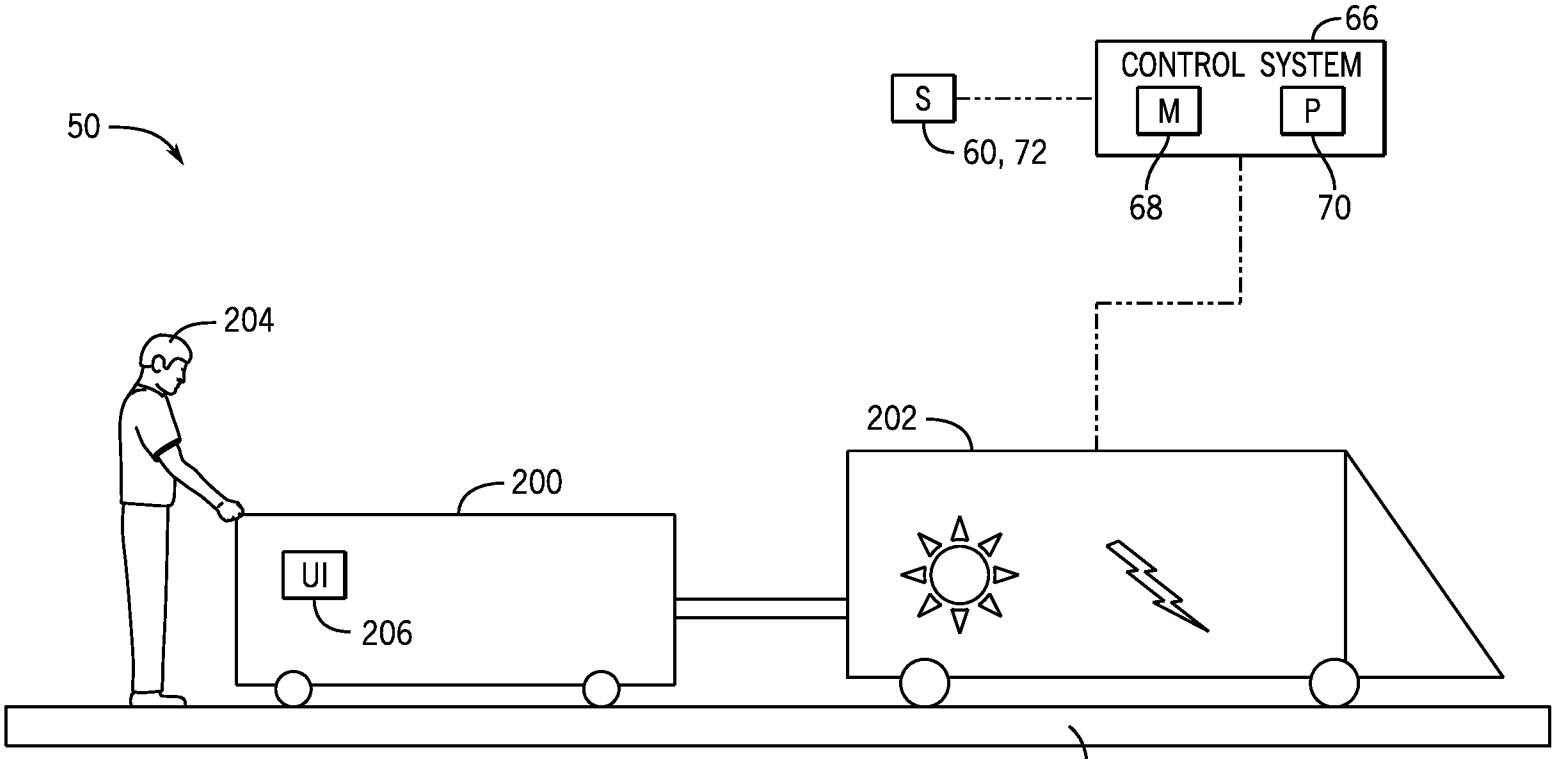
FIG. 4 is a schematic side view of an embodiment of a maintenance vehicle for performing a path maintenance operation for an attraction system, in accordance with an aspect of the present disclosure.

FIG. 4 is a schematic side view of an embodiment of a maintenance vehicle 200. The maintenance vehicle 200 may be configured to perform a maintenance operation (e.g., preparation of the path 56, application of material to the path 56, finishing of the path 56) with respect to the pathway system 54. In an embodiment, the maintenance vehicle 200 may be directly coupled to or indirectly coupled to (e.g., via a two) another vehicle 202 of the attraction system 50. For example, the vehicle 202 may include a ride vehicle in which guests may be positioned during the entertainment operation of the attraction system 50. The vehicle 202 may be a motivator, and the control system 66 may cause movement of the vehicle 202 and drive corresponding movement of the maintenance vehicle 200 along the path 56. By way of example, during a maintenance operation in which guests may not be positioned in the vehicle 202, the control system 66 may be configured to operate the vehicle 202 to move the maintenance vehicle 200 along the pathway system 54 and enable the maintenance vehicle 200 to perform a maintenance operation with respect to a particular portion of the path 56 (e.g., having an irregularity). For instance, the vehicle 202 may be configured to navigate a pre-determined route along the path 56, and movement of the vehicle 202 along the pre-determined route may drive the maintenance vehicle 200 to move substantially along the same pre-determined route. Thus, operation of the vehicle 202 may enable the maintenance vehicle 200 to address irregularities along the pre-determined route without pre-programming or pre-configuring the maintenance vehicle 200 to self-navigate the pre-determined route or otherwise self-driving the maintenance vehicle 200 along the path 56. In this way, desirable movement of the maintenance vehicle 200 (e.g., along substantially the same routes traversed by ride vehicles during the entertainment operation of the attraction system 50) may be more easily or efficiently achieved.

Additionally, or alternatively, the maintenance vehicle 200 may be manually moved along the path 56. For instance, a user 204, such as an operator and/or a technician, may impart a force (e.g., a pushing force, a pulling force, a steering force) onto the maintenance vehicle 200 to drive movement of the maintenance vehicle 200. Thus, the user 204 may manually control movement of the maintenance vehicle 200, such as to a particular irregularity of the path 56. In this manner, the maintenance vehicle 200 may be moved without communicating with the control system 66.

The user 204 may also be configured to enable or suspend operation of the maintenance components of the maintenance vehicle 200. By way of example, the maintenance vehicle 200 may include a user interface 206, such as a button, a dial, a lever, a knob, and so forth, and the user 204 may interact with the user interface 206 to cause operation of the maintenance components. For instance, the user interface 206 may be utilized to enable or interrupt supply of power to the maintenance components, to move the maintenance components, and/or otherwise control operation of the maintenance components to enable the maintenance vehicle 200 to maintain the path 56. In this manner, the maintenance vehicle 200 may operate without directly communicating with the control system 66, thereby reducing a complexity and/or cost associated with operating the maintenance vehicle 200.

Each of FIGS. 5-10 described below illustrates a maintenance vehicle (e.g., the vehicle 52 of FIG. 1, the maintenance vehicle 100 of FIG. 2, the maintenance vehicles 170, 172, 174 of FIG. 3, the maintenance vehicle 200 of FIG. 4) configured to perform a maintenance operation for a pathway system (e.g., an embodiment of the pathway system 54 of FIGS. 1-3). For example, each maintenance vehicle, which may represent multiple maintenance vehicles configured to perform different operations, may be configured to prepare a path of the pathway system, apply a material to the path, distribute the material across the path, finish the applied material, and so forth. In one embodiment, the control system 66 may be configured to control operation of the maintenance vehicle, such as to travel along the path and/or to operate the maintenance components of the maintenance vehicle. In an additional or alternative embodiment, the maintenance vehicle may be manually operated by a user, driven to move via a ride vehicle, and/or operated using any other suitable technique. In each embodiment, the maintenance vehicle may move along the pathway system by utilizing a common or existing component utilized by a ride vehicle during an entertainment operation of the attraction system. As such, the maintenance vehicle may be configured to navigate the pathway system without usage of a separate, dedicated system or component of the pathway system specifically implemented to enable movement of the maintenance vehicle along the pathway system. Thus, a cost associated with implementation and/or operation of the maintenance vehicle may be reduced or limited.

Figure 5:
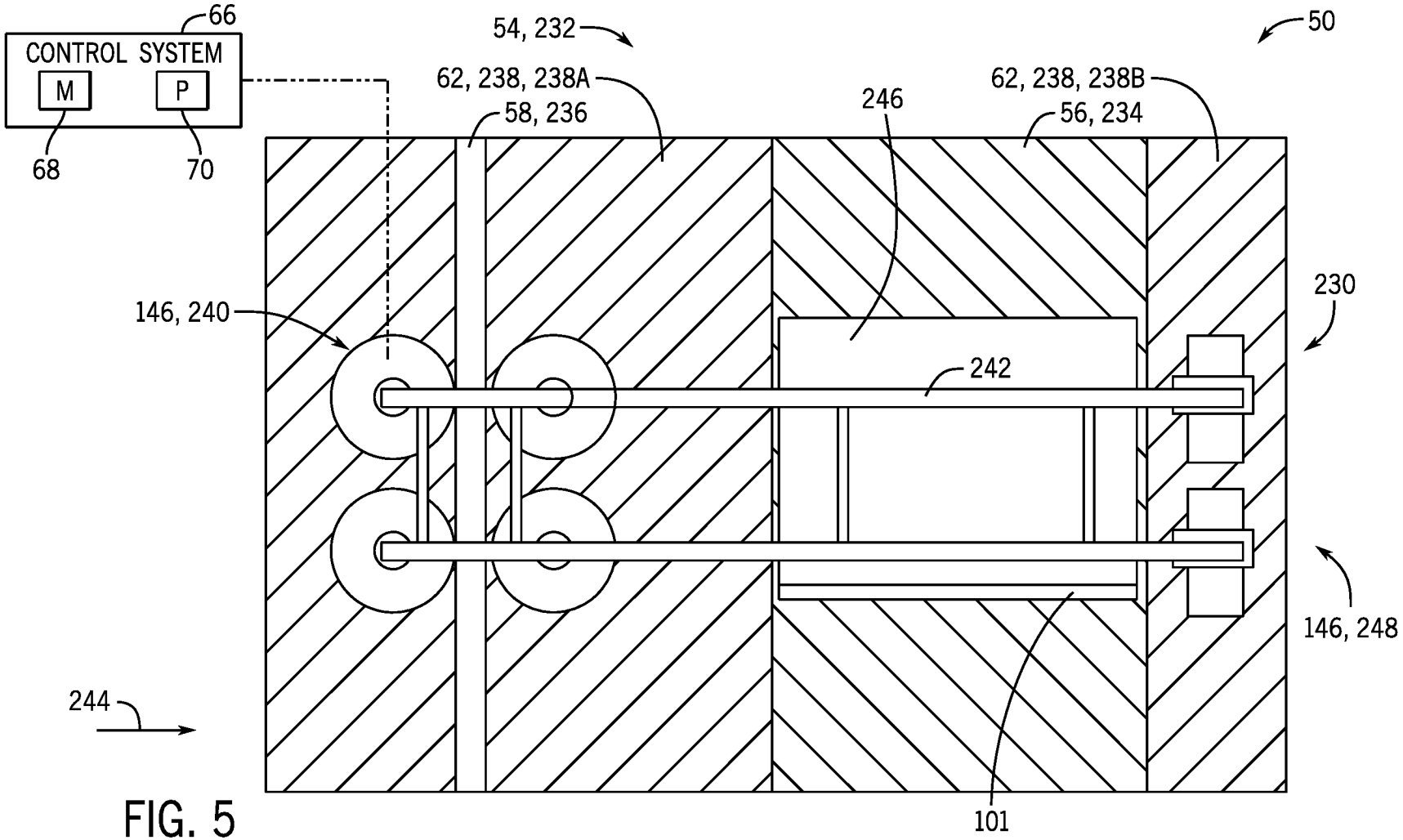
FIG. 5 is a schematic top view of an embodiment of a maintenance vehicle for performing a path maintenance operation for an attraction system, in accordance with an aspect of the present disclosure.

FIG. 5 is a schematic top view of an embodiment of a maintenance vehicle 230 configured to perform a maintenance operation for a pathway system 232 of the attraction system 50. For example, the maintenance vehicle 230 may be configured to apply material onto a path 234 of the pathway system 232. The path 234 may include a portion of the pathway system 232 in which a ride vehicle may engage with or contact (e.g., via one or more wheels of the ride vehicle) during the entertainment operation of the attraction system 50. For example, the illustrated pathway system 232 includes a projection 236 (e.g., a rail, a wall, an extension, a partition, a barrier) extending from a base 238 (e.g., a first base portion 238A) of the pathway system 232 surrounding the path 234. Thus, the projection 236 may be separate from (e.g., not directly connected to or a part of) the path 234. The ride vehicle may utilize the projection 236 as the guide 58 to direct movement of the ride vehicle along the path 234. For example, the projection 236 may guide the ride vehicle along the pathway system 232 to cause the ride vehicle to maintain engagement with the path 234. The maintenance vehicle 230 may similarly utilize the projection 236 to move along and perform maintenance with respect to the path 234.

The maintenance vehicle 230 may include a first set of wheels 240 (e.g., four wheels, three wheels, two wheels, more than four wheels) configured to engage with and capture the projection 236. In this manner, the first set of wheels 240 may be guide engagers configured to maintain contact with the projection 236. Moreover, the maintenance vehicle 230 may include a frame 242 coupled to the first set of wheels 240 and extending across the pathway system 232. For instance, the frame 242 may extend along a lateral axis 244 across the first base portion 238A and the path 234 to a second base portion 238B adjacent to the path 234, and a chassis 246 of the maintenance vehicle 230 may be coupled to the frame 242. The frame 242 may offset the chassis 246 relative to the projection 236 along the lateral axis 244 while the first set of wheels 240 captures the projection 236 to enable the chassis 246 to overlap (e.g., laterally overlap) with the path 234 along the lateral axis 244. The chassis 246 may include the maintenance components 101 configured to perform maintenance on the path 234. Furthermore, the maintenance vehicle 230 may include a second set of wheels 248 coupled to the frame 242 and configured to engage with the second base portion 238B while the first set of wheels 240 captures the projection 236.

The control system 66 may drive the first set of wheels 240 to rotate (e.g., via an actuator, via another vehicle, via a motivator) while the first set of wheels 240 maintains capture of the projection 236 to move along the projection 236, and the control system 66 may drive the second set of wheels 248 to rotate (e.g., via an actuator, via another vehicle, via a motivator) and move along the second base portion 238B while maintaining engagement with the second base portion 238B in order to drive movement of the chassis 246 along the path 234. In this manner, the first set of wheels 240 and the second set of wheels 248 may avoid contact with the path 234, which may be offset from the first base portion 238A and/or the second base portion 238B along the lateral axis 244, in order to facilitate performance of maintenance on the path 234. That is, the first set of wheels 240 and the second set of wheels 248 may not contact the path 234 to avoid affecting operation of the maintenance components 101 (e.g., application of material, finishing of applied material) with respect to the path 234, thereby enabling effective and/or efficient operation to maintain the path 234. Moreover, since the ride vehicle may not contact the base 238 during the entertainment operation of the attraction system 50, the maintenance vehicle 230 may not perform maintenance for the base 238 (e.g., the chassis 246 and the maintenance components 101 may not laterally overlap with the first base portion 238A and/or the second base portion 238B) to perform efficient maintenance operation for the pathway system 232.

Figure 6:
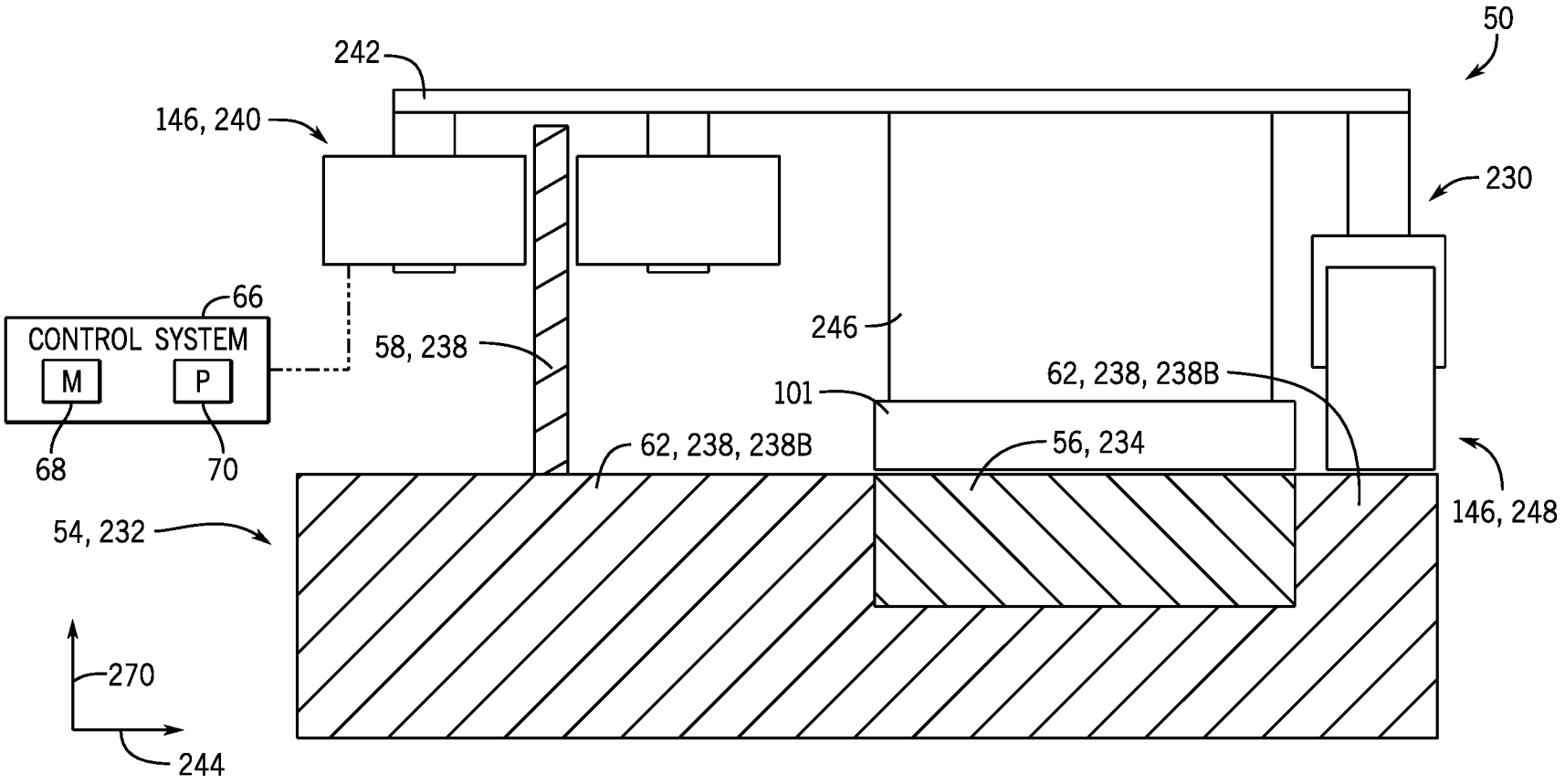
FIG. 6 is a schematic elevation view of an embodiment of a maintenance vehicle for performing a path maintenance operation for an attraction system, in accordance with an aspect of the present disclosure.

FIG. 6 is a schematic elevation view (e.g., a front view, a rear view) of an embodiment of the maintenance vehicle 230. The engagement between the first set of wheels 240 and the projection 236 (e.g., capture of the projection 236 via the first set of wheels 240) may block relative movement between the maintenance vehicle 230 and the pathway system 54 along the lateral axis 244. As such, the first set of wheels 240 may maintain the overlap between the chassis 246 and the path 234 along the lateral axis 244 to enable the maintenance components 101 to perform maintenance for (e.g., apply material onto) the path 234. Indeed, the maintenance vehicle 230 may follow along the projection 236, such as along a curve formed by the projection 236, via the engagement between the first set of wheels 240 and the projection 236. Furthermore, the engagement between the first set of wheels 240 and the projection 236 and the engagement between the second set of wheels 248 and the second base portion 238B may cooperatively block relative movement between the maintenance vehicle 230 and the pathway system 54 along a vertical axis 270. By way of example, the first set of wheels 240 and the second set of wheels 248 may offset the chassis 246 from the path 234 at a target distance along the vertical axis 270 to facilitate operation of the maintenance components 101 to maintain the path 234.

Figure 7:
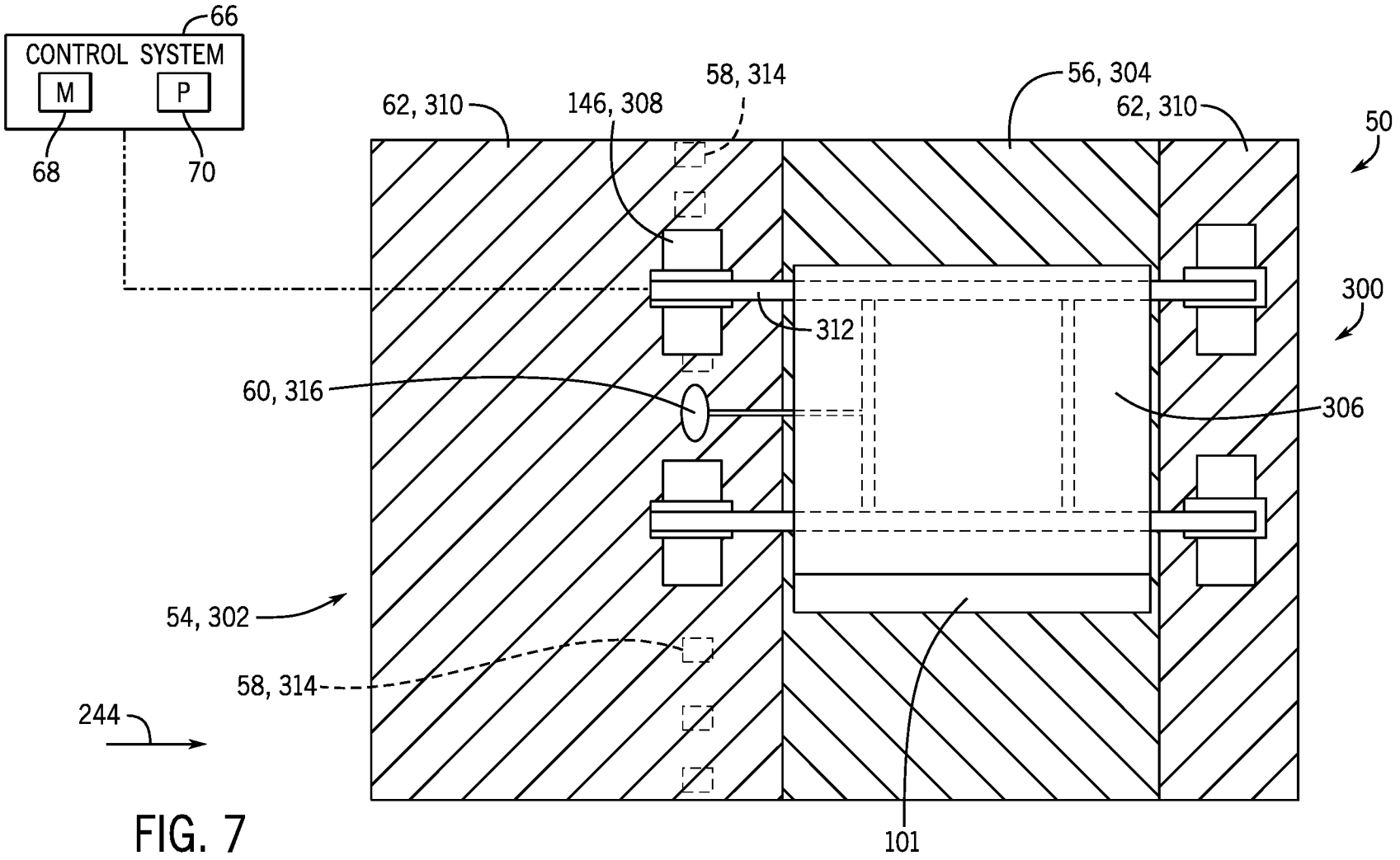
FIG. 7 is a schematic top view of an embodiment of a maintenance vehicle for performing a path maintenance operation for an attraction system, in accordance with an aspect of the present disclosure.

FIG. 7 is a schematic top view of an embodiment of a maintenance vehicle 300 configured to perform maintenance for a pathway system 302 of the attraction system 50, such as for a path 304 of the pathway system 302. To this end, the maintenance vehicle 300 may include a chassis 306 having the maintenance components 101 configured to perform maintenance for the path 304. Additionally, the maintenance vehicle 300 may include wheels 308 configured to engage with a base 310 separate from and surrounding the path 304. The chassis 306 and the wheels 308 may be coupled a frame 312 of the maintenance vehicle 300 to enable movement (e.g., rotation) of the wheels 308 to drive corresponding movement of the chassis 306 along the path 304.

The pathway system 302 may include guides or flags 314 utilized by a ride vehicle to move along the path 304 during the entertainment operation of the attraction system 50 and utilized by the maintenance vehicle 300 to travel along the pathway system 302 to maintain the path 304. For instance, the guides 314 may be used by the maintenance vehicle 300 to move the wheels 308 along the base 310 and maintain an overlap (e.g., a lateral overlap) between the chassis 306 and the path 304 and block overlap between the chassis 306 and the base 310. The guides 314 may also enable movement of the maintenance vehicle 300 to block contact between the wheels 308 and the path 304. For instance, the guides 314 may direct the maintenance vehicle 300 through the pathway system 302 without coming into contact with the maintenance vehicle 300. By way of example, the maintenance vehicle 300 may include a sensor 316 (e.g., the vehicle sensor 60) configured to enable navigation of the maintenance vehicle 300 along the path 304 by utilizing the guides 314. The sensor 316 extends along the lateral axis 244 between two of the wheels 308 in the illustrated embodiment, but the sensor 316 may be configured to be positioned in any suitable manner in an additional or alternative embodiment. In an embodiment, the control system 66 may be communicatively coupled to the sensor 316 and may be configured to drive movement of the maintenance vehicle 300, such as steering of the chassis 306 via the wheels 308, based on data received from the sensor 316. As an example, the sensor 316 may be configured to monitor a parameter associated with a property of the guides 314. The control system 66 may instruct the maintenance vehicle 300 to move along the pathway system 302 based on the parameter to move the maintenance component 101 along the path 304. For instance, the control system 66 may cause the wheel 308 to move along the base 310 (e.g., via an actuator, via another ride vehicle, via a motivator) to move the sensor 316 relative to one or more of the guides 314 (e.g., to align the sensor 316 with one or more of the guides 314) in order to cause the chassis 306 to overlap with the path 304 and enable the maintenance component 101 to perform maintenance for the path 304.

For example, the sensor 316 may include an optical sensor (e.g., a camera), which may be configured to capture an image of the guides 314. For example, the guides 314 may include an indicator (e.g., a barcode), and the optical sensor may detect the indicator, such as by capturing an image of the indicator. The control system 66 may utilize the detected indicator to control movement of the maintenance vehicle 300, such as based on a comparison between an appearance and/or positioning of one or more guides 314 of the captured image relative to a target appearance and/or positioning of the one or more guides 314 (e.g., indicative of a target alignment between the sensor 316 and one or more of the guides 314). As an example, the control system 66 may steer the wheels 308 to adjust the appearance and/or positioning of the one or more guides 314 of the captured image toward the target appearance and/or positioning.

Additionally, or alternatively, the sensor 316 (e.g., a transceiver) may be configured to transmit a signal (e.g., an ultrasonic sensor, a sound wave, an electrical signal, an electromagnetic wave) and receive a reflection of the transmitted signal. For example, the signal may deflect off the guides 314 toward the sensor 316 as a reflected signal. As such, the guides 314 may be made of a retro-reflective material to enable deflection of the signal (e.g., toward the sensor 316). A property (e.g., an intensity, a frequency, a wavelength, an angle, a direction) of the reflected signal may be based on a manner in which the output signal deflects off one or more guides 314, such as a specific portion of one or more guides 314 off which the output signal deflects, an angle of deflection off one or more guides 314, and so forth. The property may be indicative of an alignment between the sensor 316 and one or more of the guides 314, and the control system 66 may receive the property via the data from the sensor 316. The control system 66 may determine the property of the reflected signal, compare the determined property to a target property of the reflected signal (e.g., indicative of a target alignment between the sensor 316 and one or more of the guides 314), and control movement of the maintenance vehicle 300 based on the comparison (e.g., by steering the wheels 308 to adjust the determined property toward the target property).

In a further embodiment, the guides 314 (e.g., transmitters) may be configured to transmit a signal, and the sensor 316 may be configured to receive the signal transmitted by the guides 314. A property (e.g., an intensity, a frequency, a wavelength, an angle, a direction) of the received signal may be based on an alignment between the sensor 316 and one or more of the guides 314. The control system 66 may receive the property via the data from the sensor 316, compare the property of the received signal with a target property of the signal received by the sensor 316 (e.g., indicative of a target alignment between the sensor 316 and one or more of the guides 314), and control movement of the maintenance vehicle 300 based on the comparison, such as to adjust the property of the received signal toward the target property.

The guides 314 may be embedded within the base 310 in an embodiment. As such, the base 310 may be composed of a particular material (e.g., a transparent material, a transmissive material, a porous material) to enable utilization, such as viewing and/or signal transmission, via the sensor 316 to control movement of the maintenance vehicle 300. Additionally, or alternatively, the guides 314 may be placed on top of a surface of the base 310 and may therefore be exposed to facilitate utilization via the sensor 316. Moreover, in an embodiment, a section of the path 304 may be identified as being in need of maintenance (e.g., via the control system 66) and when a guide 314 associated with (e.g., positioned at or adjacent to) a section in need of maintenance is detected by the sensor 316, the maintenance vehicle 300 may be instructed to initiate a repair operation.

In any case, controlling movement of the maintenance vehicle 300 via the control system 66 and based on data received from the sensor 316 may maintain the overlap between the chassis 306 and the path 304 to enable the maintenance components 101 to perform maintenance for the path 304. However, in an additional or alternative embodiment, movement of the maintenance vehicle 300 may be controlled in a different manner to move the maintenance vehicle 300 along the pathway system 54 without usage of a physical guide configured to direct the maintenance vehicle 300. By way of example, the maintenance vehicle 300 may be configured to travel along a pre-programmed or pre-set route, and the control system 66 may be configured to control movement (e.g., rotation, steering) of the wheels 308 based on the pre-programmed route.

Figure 8:
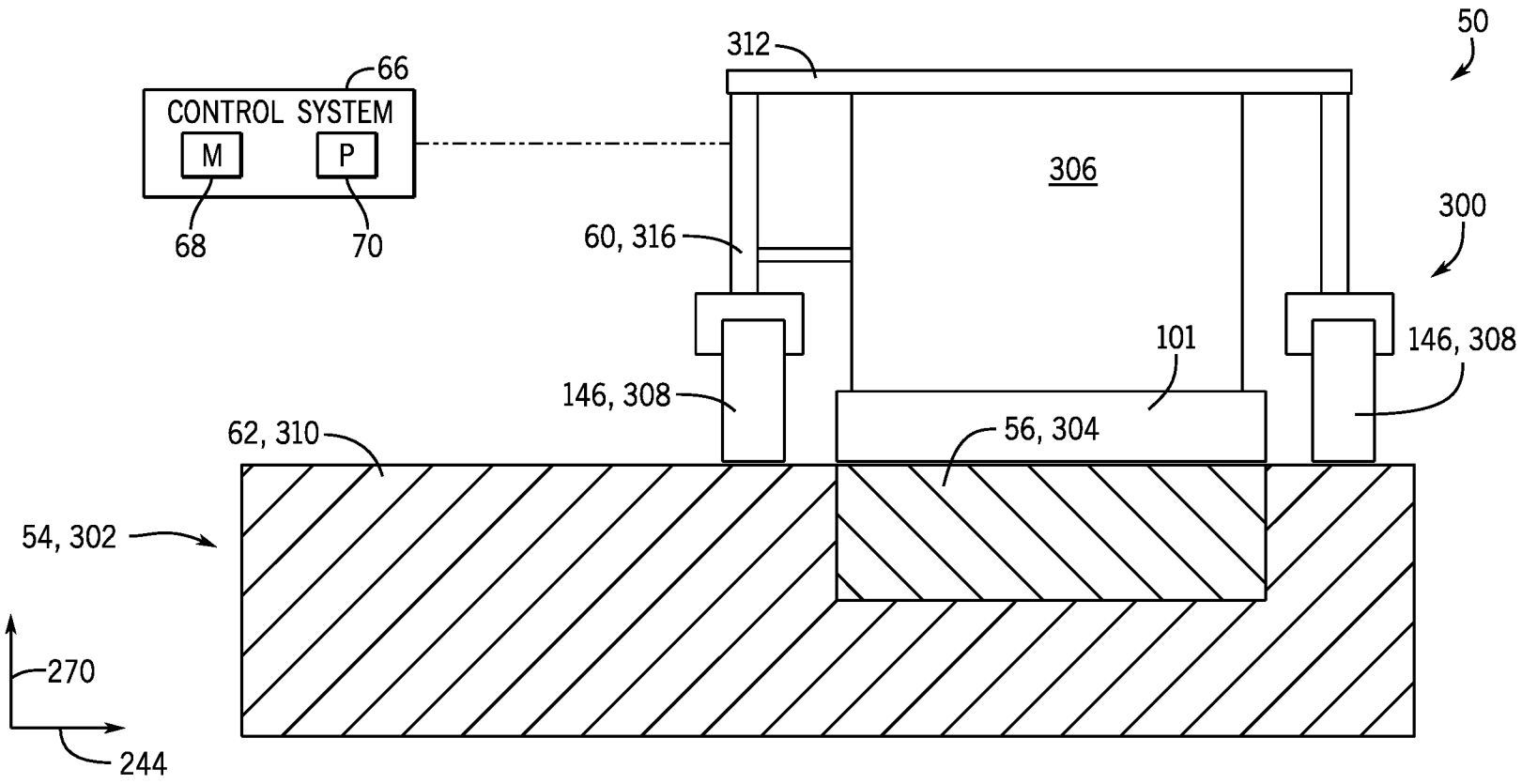
FIG. 8 is a schematic elevation view of an embodiment of a maintenance vehicle for performing a path maintenance operation for an attraction system, in accordance with an aspect of the present disclosure.

FIG. 8 is an elevation view of an embodiment of the maintenance vehicle 300. Each of the wheels 308 may be configured to engage with the base 310 and block relative movement between the maintenance vehicle 300 and the pathway system 302 along the vertical axis 270. For example, the wheels 308 may offset the chassis 306 from the path 304 at a target distance along the vertical axis 270 that facilitates operation of the maintenance components 101 to maintain the path 304. In the illustrated embodiment, the sensor 316 is coupled to the chassis 306. In an additional or alternative embodiment, the sensor 316 may be arranged in any suitable manner to enable the sensor 316 to help navigate the maintenance vehicle 300 (e.g., to enable the sensor 316 to align with the guides). For example, the sensor 316 may be configured to couple to the wheels 308, the frame 312, and so forth.

Figure 9:
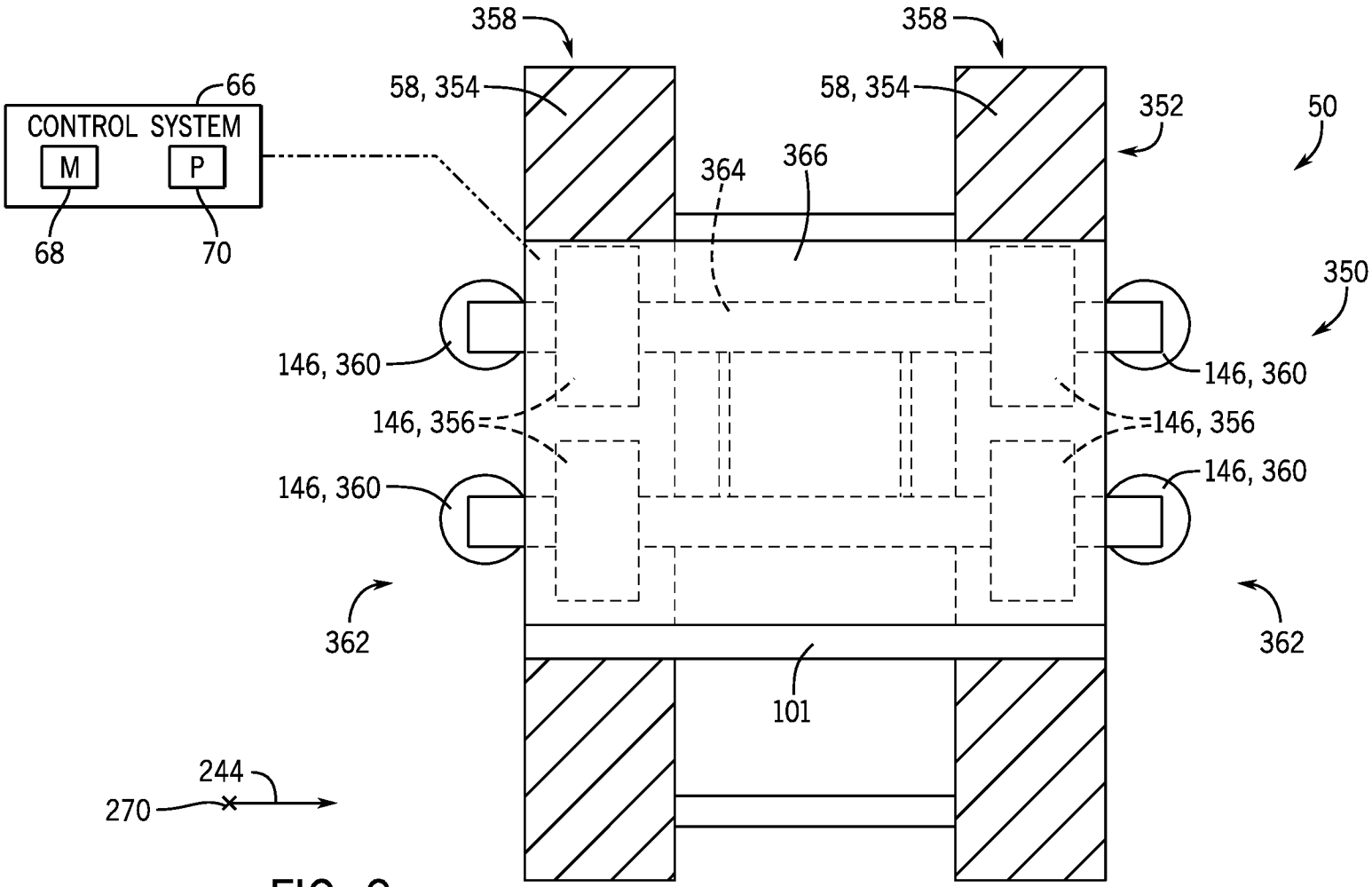
FIG. 9 is a schematic top view of an embodiment of a maintenance vehicle for performing a path maintenance operation for an attraction system, in accordance with an aspect of the present disclosure.

FIG. 9 is a schematic top view of an embodiment of a maintenance vehicle 350 for performing maintenance on a pathway system 352. For example, a path 354 of the pathway system 352 may include rails or bars with which a ride vehicle may be engaged and along which the ride vehicle may move during the entertainment operation of the attraction system 50. The maintenance vehicle 350 may also be configured to engage with the path 354, such as by extending across each of the rails (e.g., along the lateral axis 244), to maintain the path 354. By way of example, the maintenance vehicle 350 may include a first set of wheels 356 configured to engage with a first side 358 (e.g., a top side) of the path 354, a second set of wheels 360 configured to engage with second sides 362 (e.g., lateral sides, exterior sides) of the path 354, and/or a third set of wheels (not shown) configured to engage with a third side (e.g., an underside), opposite the first side 358, of the path 354. As such, the first set of wheels 356, the second set of wheels 360, and/or the third set of wheels may cooperatively capture the path 354 to block relative movement between the maintenance vehicle 350 and the pathway system 352 along the lateral axis 244 and/or the vertical axis 270, thereby coupling the maintenance vehicle 350 to the pathway system 352. Moreover, rotation of the first set of wheels 356, the second set of wheels 360, and/or the third set of wheels while maintaining capture of the path 354 may drive movement (e.g., translational movement) of the maintenance vehicle 350 along the path 354. For example, the first set of wheels 356, the second set of wheels 360, and/or the third set of wheels may maintain capture of the path 354 during movement of the maintenance vehicle 350 along the path 354 to enable the path 354 to guide the movement of the maintenance vehicle 350.

The maintenance vehicle 350 may also include a frame 364 coupled to the first set of wheels 356, the second set of wheels 360, and/or the third set of wheels, as well as a chassis 366 coupled to the frame 364 and having the maintenance components 101. The chassis 366 may overlap with the path 354 along the lateral axis 244 (e.g., the chassis 366 may extend across an entirety of the path 354) to enable the maintenance components 101 to perform maintenance with respect to the path 354. The first side 358 may face the chassis 366 and therefore the maintenance components 101, and the maintenance components 101 may therefore be configured to perform maintenance with respect to (e.g., apply a material to) the first side 358. For example, the first set of wheels 356 may be positioned between the chassis 366 and the path 354 and may offset the chassis 366 from the path 354 at a target distance along the vertical axis 270 to facilitate operation of the maintenance components 101 to maintain the path 354. However, operation of the maintenance components 101 may also enable the maintenance components 101 to maintain other sides of the path 354, such as the second sides 362 and/or the third side. By way of example, material applied to the first side 358 may be distributed across the other sides of the path 354 (e.g., via operation of the maintenance components 101), and/or the maintenance components 101 may be configured to adjust or move to perform maintenance directly with respect to the other sides of the path 354.

Figure 10:
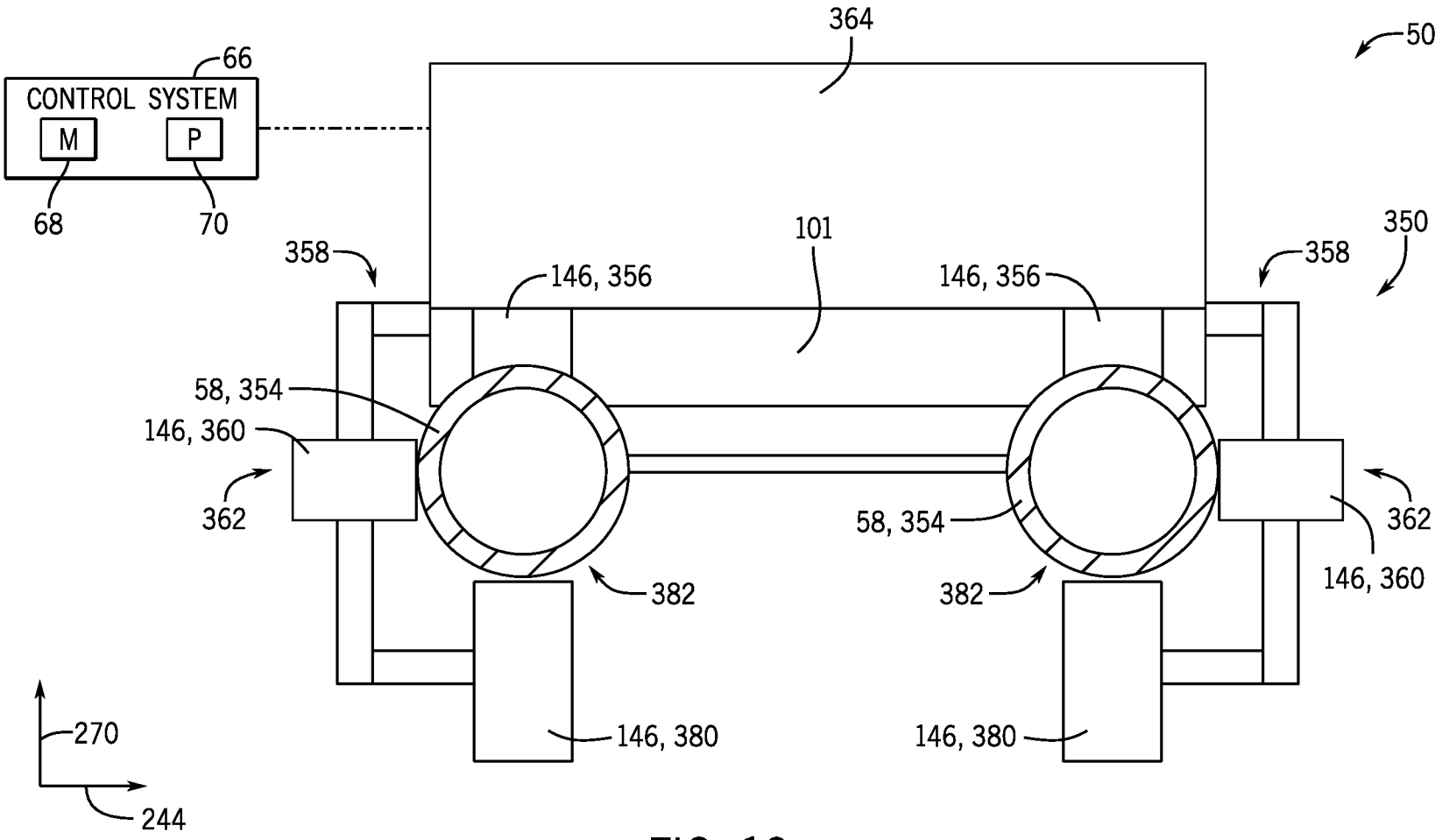
FIG. 10 is a schematic elevation view of an embodiment of a maintenance vehicle for performing a path maintenance operation for an attraction system, in accordance with an aspect of the present disclosure.

FIG. 10 is an elevation view of an embodiment of the maintenance vehicle 350. The maintenance vehicle 350 may include a third set of wheels 380 configured to engage with a third side 382 (e.g., an underside), opposite the first side 358, of the path 354. The first set of wheels 356 and the third set of wheels 380 may capture the first side 358 and the third side 382 of the path 354 to block relative movement between the chassis 366 and the path 354 along the vertical axis 270. Additionally, the second set of wheels 360 may capture the second sides 362 of the path 354 to block relative movement between the chassis 366 and the path 354 along the lateral axis 244. Thus, the first set of wheels 356, the second set of wheels 360, and the third set of wheels 380 may be path engagers in the illustrated embodiment and may maintain contact with the path 354. The control system 66 may drive movement of any of the sets of wheels 356, 360, 380 (e.g., via an actuator, via another ride vehicle, via a motivator) to move the maintenance vehicle 350 along the path 354. Although the illustrated maintenance vehicle 350 includes three sets of wheels configured to engage with the first side 358, the second sides 362, and the third side 382, respectively, of the path 354, the maintenance vehicle 350 may include any quantity of sets of wheels and/or any quantity of wheels configured to engage with any suitable sides of the path 354 to capture the path 354 and enable movement of the maintenance vehicle 350 along the path 354.

Figure 11:
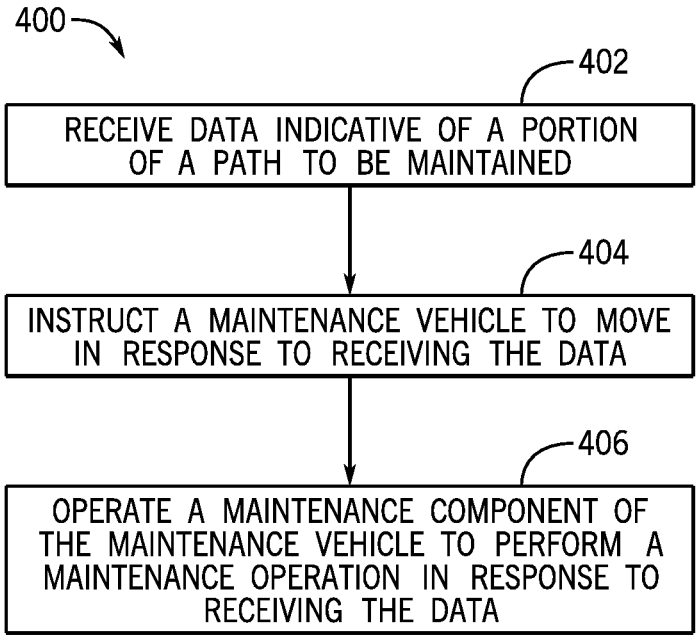
FIG. 11 is a flowchart of an embodiment of a method or process for operating a path maintenance vehicle, in accordance with an aspect of the present disclosure.

FIG. 11 is a flowchart of an embodiment of a method or process 400 for operating a maintenance vehicle (e.g., the vehicle 52 of FIG. 1, the maintenance vehicle 100 of FIG. 2, the maintenance vehicles 170, 172, 174 of FIG. 3, the maintenance vehicle 200 of FIG. 4, the maintenance vehicle 230 of FIGS. 5 and 6, the maintenance vehicle 300 of FIGS. 7 and 8, the maintenance vehicle 350 of FIGS. 9 and 10). Any suitable device (e.g., the processing circuitry 70 of the control system 66 of FIGS. 1-10) may perform the method 400. In one embodiment, the method 400 may be implemented by executing instructions stored in a tangible, non-transitory, computer-readable medium (e.g., the memory 68 of the control system 66). For example, the method 400 may be performed at least in part by one or more software components, one or more hardware components, one or more software applications, and the like. While the method 400 is described using steps in a specific sequence, additional steps may be performed, the described steps may be performed in different sequences than the sequence illustrated, and/or certain described steps may be skipped or not performed altogether.

At block 402, data indicative that at least a portion of a path of an attraction system is to be maintained. As an example, the data may be received from a sensor, which may be configured to monitor a property of the path, and the data may be indicative of an irregularity of the path. As another example, the data may be indicative that a threshold period of time (e.g., since performance of a previous maintenance operation) has passed. As a further example, the data may be received via a user input, which may be indicative of a request to maintain the portion of the path.

At block 404, in response to receiving the data, a maintenance vehicle may be instructed to move. In one embodiment, a target location (e.g., of the path) may be determined based on the data. As an example, the target location may correspond to the portion of the path to be maintained, and the maintenance vehicle may be instructed to move toward the target location. For instance, an actuator of the maintenance vehicle may be instructed to rotate a wheel of the maintenance vehicle to drive movement of the maintenance vehicle to the target location. Furthermore, a speed of the maintenance vehicle may be controlled. By way of example, the maintenance vehicle may be instructed to move at a first speed (e.g., an increased speed) in response to determining that the maintenance vehicle is outside of the target location. The maintenance vehicle may be instructed to move at a second speed (e.g., a reduced speed) in response to determining that the maintenance vehicle is within the target location. For instance, movement of the maintenance vehicle at the second speed may facilitate performing a maintenance operation for the path.

At block 406, a maintenance component of the maintenance vehicle may be instructed to operate to perform a maintenance operation for the path in response to receiving the data. For example, the maintenance component may be configured to prepare the path, apply material to the path, distribute applied material across the path, finish the applied material, and so forth. An actuator of the maintenance vehicle may be instructed to operate the maintenance component. In an embodiment, operation of the maintenance component may be selectively enabled. By way of example, operation of the maintenance component may be enabled in response to determining that the maintenance vehicle is within the target location associated with the portion of the path, and operation of the maintenance component may be suspended in response to determining that the maintenance vehicle is outside of the target location. For example, the maintenance component may specifically operate for the portion of the path to be maintained, thereby avoiding continual operation of the maintenance component and reducing or limiting a cost and/or energy consumption associated with performing the maintenance operation for the path. Additionally, or alternatively, the maintenance component may be operated to perform maintenance for different portions of the path, such as while the maintenance vehicle is outside of the target location associated with the portion of the path. That is, the maintenance operation may be performed for other portions of the path (e.g., while the maintenance vehicle is moving toward the target location) in addition to the portion to be maintained as initially indicated by the received data.

In an additional or alternative embodiment, operation of the maintenance component may be adjusted based on an operation of an additional maintenance component. For instance, in response to determining that a binding material has been applied by a first maintenance component, a second maintenance component may be operated to treat and/or cure the binding material (e.g., within a threshold period of time since the binding material has been applied by the first maintenance component) to enable a desirable finish of the binding material. Thus, the operation of each maintenance component may be more suitably performed with respect to one another, such as to coordinate the operation of respective maintenance components to perform a desirable maintenance operation for the path.

In a further embodiment, the maintenance component may be operated based on a property of the path and/or the material being applied to the path. As an example, the maintenance component may be operated to apply an amount of material based on an identified irregularity of the path, such as to increase the amount and/or a flowrate of material being applied proportionally with respect to a size of the irregularity. As another example, the maintenance component may be operated to treat applied material based on an amount of the material that has been applied and/or a location of the applied material. For instance, a duration of time associated with treating the applied material may be increased proportionally with respect to the amount of the applied material, and/or the treatment operation may specifically be applied to a detected location where the material has been applied (e.g., to more readily finish, bind, cure, and/or block accumulation and/or movement of the applied material with respect to the path). As such, the maintenance of the path may be more suitably performed to mitigate a particular irregularity and/or path.

It should be noted that the method 400 may be independently performed for different maintenance vehicles. That is, different maintenance vehicles may be instructed to move relative to one another, such as to address different portions of a path to be maintained. Additionally, different maintenance components associated with the maintenance vehicles may be operated to perform different maintenance operations for respective portions of the path. Indeed, multiple maintenance vehicles may be operated via the method 400 in order to simultaneously or concurrently maintain different portions of the path.

While only certain features of the disclosure have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for (perform)ing (a function) . . . " or "step for (perform)ing (a function) . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. An attraction system comprising:

a maintenance vehicle;

a pathway system;

a sensor configured to detect a parameter associated with the attraction system;

an automation control system configured to perform operations comprising:

receiving data from the sensor, wherein the data is indicative of the parameter associated with the attraction system; and controlling a movement of the maintenance vehicle along the pathway system based on the data;

a maintenance component of the maintenance vehicle, wherein the maintenance component is configured to output a material onto a path of the pathway system of the attraction system;

a guide engager of the maintenance vehicle, wherein the guide engager is configured to capture a projection of the pathway system, wherein the projection is separate from the path; and a set of wheels of the maintenance vehicle, wherein the set of wheels is configured to engage the pathway system to enable the movement of the maintenance vehicle along the pathway system while the guide engager maintains capture of the projection.

2. The attraction system of claim 1, comprising a motivator of the maintenance vehicle, wherein the guide engager comprises an additional set of wheels configured to capture the projection and the motivator is configured to rotate the set of wheels and the additional set of wheels to cause the maintenance vehicle to move along the projection while the additional set of wheels maintain capture of the projection.

3. The attraction system of claim 2, wherein the sensor is an optical sensor configured to detect a structural change associated with the pathway system, and the parameter associated with the attraction system comprises the structural change associated with the pathway system.

4. The attraction system of claim 1, wherein the set of wheels is configured to engage with a base portion of the pathway system, and the base portion is laterally offset from the path.

5. The attraction system of claim 1, wherein the sensor is disposed on the maintenance vehicle.

6. The attraction system of claim 1, wherein the sensor is configured to detect a property associated with the projection, and the property associated with the projection corresponds to the parameter associated with the attraction system.

7. An attraction system, comprising:

a maintenance vehicle;

a pathway system;

a sensor configured to detect a parameter associated with the attraction system;

an automation control system configured to perform operations comprising:

receiving data from the sensor, wherein the data is indicative of the parameter associated with the attraction system; and controlling a movement of the maintenance vehicle along the pathway system based on the data;

a maintenance component of the maintenance vehicle, the maintenance component comprising a first maintenance section configured to output a material onto a surface of a path of the pathway system of the attraction system and a second maintenance section configured to treat the material outputted onto the surface;

a path engager of the maintenance vehicle, wherein the path engager is configured to contact the surface and capture the path; and a motivator of the maintenance vehicle, wherein the motivator is configured to move the maintenance component along the path via the path engager while maintaining capture of the path to move the maintenance component along the path.

8. The attraction system of claim 7, comprising a chassis of the maintenance vehicle, the chassis comprising the maintenance component, wherein the chassis is configured to overlap with the path along a lateral axis while the path engager captures the path to enable the maintenance component to output the material onto the path.

9. The attraction system of claim 8, wherein the sensor is an optical sensor configured to detect irregularities associated with the path, and the irregularities associated with the path correspond to the parameter associated with the attraction system.

10. The attraction system of claim 8, wherein the path engager comprises:

a first set of wheels configured to engage with the surface at a first side of the path, wherein the first side faces the chassis and the first set of wheels is positioned between the chassis and the path; and a second set of wheels configured to engage with a second side of the path, wherein the second side is an exterior lateral side.

11. The attraction system of claim 7, wherein the sensor is physically discrete from the maintenance vehicle.

12. The attraction system of claim 7, wherein the maintenance vehicle comprises the sensor.

13. The attraction system of claim 7, wherein the second maintenance section is configured to deposit a curing material onto the material to solidify the material from a fluid state.

14. A attraction system, the maintenance vehicle comprising:

a maintenance component configured to output a material onto a path of a pathway system of the attraction system;

a sensor configured to monitor a parameter associated with a property of a guide of the pathway system; and a control system configured to perform operations comprising:

receiving data from the sensor, wherein the data is indicative of the parameter associated with the property of the guide; and controlling movement of the maintenance vehicle based on the parameter to move the maintenance component along the path.

15. The maintenance vehicle of claim 14, wherein the maintenance vehicle avoids contact with the guide during the movement controlled by the control system.

16. The maintenance vehicle of claim 14, wherein the control system is configured to perform operations comprising:

comparing the parameter associated with the property of the guide to a target parameter; and controlling the movement of the maintenance vehicle to adjust the parameter toward the target parameter.

17. The maintenance vehicle of claim 14, wherein the sensor comprises an optical sensor configured to capture an image, and the parameter comprises an image of the guide.

18. The maintenance vehicle of claim 14, wherein the sensor comprises a transceiver configured to transmit an output signal and receive a reflected signal resulting from the output signal deflecting off the guide, and the parameter comprises a property of the reflected signal.

19. The maintenance vehicle of claim 14, wherein the sensor is configured to receive a signal transmitted by the guide, and the parameter comprises a property of the signal.

20. The maintenance vehicle of claim 14, comprising a wheel configured to engage with a base of the pathway system, wherein the base is separate from the path of the pathway system; and a motivator configured to drive movement of the wheel, wherein the control system is configured to operate the motivator to drive movement of the wheel along the base based on the parameter associated with the property of the guide to move the maintenance component along the path.

* * * * *